US006195017B1

(12) United States Patent
Smith et al.

(10) Patent No.: US 6,195,017 B1
(45) Date of Patent: Feb. 27, 2001

(54) USER INTERACTIVE DISPLAY FOR BATTING CAGE WITH PITCH HEIGHT INDICATOR LAMPS AND STRIKE ZONE

(75) Inventors: Tommy L. Smith; Richard E. Hall, both of Salem, OR (US)

(73) Assignee: Automated Batting Cages, Salem, OR (US)

( * ) Notice: Subject to any disclaimer, the term of this patent is extended or adjusted under 35 U.S.C. 154(b) by 0 days.

(21) Appl. No.: 09/295,745

(22) Filed: Apr. 20, 1999

Related U.S. Application Data

(60) Provisional application No. 60/123,258, filed on Mar. 8, 1999.

(51) Int. Cl.[7] ..... G08B 5/36

(52) U.S. Cl. ..... 340/815.48; 124/78; 473/453

(58) Field of Search ..... 340/815.48, 323 R; 473/451, 453, 468; 124/51.1, 78, 9, 6; 434/247; 273/371

(56) References Cited

U.S. PATENT DOCUMENTS

| | | | | |
|---|---|---|---|---|
| 4,197,827 | | 4/1980 | Smith | 273/260 |
| 4,461,477 | * | 7/1984 | Stewart | 473/453 |
| 4,834,060 | | 5/1989 | Greene | 273/26 D |
| 5,125,653 | | 6/1992 | Kovacs | 273/26 D |
| 5,359,986 | | 11/1994 | Magrath, III | 124/1 |
| 5,460,363 | * | 10/1995 | Tomer | 273/26 A |
| 5,464,208 | * | 11/1995 | Pierce | 124/78 |

FOREIGN PATENT DOCUMENTS

| | | |
|---|---|---|
| 4021282A1 | 10/1991 | (DE) . |
| 73 08342 | 3/1973 | (FR) . |

* cited by examiner

*Primary Examiner*—Jeffery A. Hofsass
*Assistant Examiner*—John Tweel, Jr.
(74) *Attorney, Agent, or Firm*—Marger Johnson & McCollom, P.C.

(57) ABSTRACT

The invention is a user control panel for a pitching system with a pitching mechanism. The control panel allows a user to separately control ball speed and tilt angle. The control panel also displays an estimated height at which the ball will cross the plate for the selected ball speed and tilt angle. In the preferred embodiment, a vertical row of lamps shows the estimated ball height. The control panel can include symbology to indicate strike zones for batters of different heights.

12 Claims, 7 Drawing Sheets

USER INTERACTIVE DISPLAY FOR BATTING CAGE WITH PITCH HEIGHT INDICATOR LAMPS AND STRIKE ZONE

This is a continuation of Ser. No. 60/123,258 filed Mar. 8, 1999.

BACKGROUND OF THE INVENTION

This invention relates to a system and method for pitching a ball, and more particularly to a system and method for controlling ball speed and angle.

Pitching systems have a mechanism for hurling a ball, in which the speed of the ball is variable by controlling the mechanism speed and the elevation of the ball at a given distance is controlled by the varying angle at which the mechanism launches the ball. In prior systems, these control features have been implemented mechanically.

More modem systems have motor controls that can be remotely actuated to change ball speed and height. U.S. Pat. No. 5,125,653 to Kovacs, incorporated by reference, describes a system that includes a microcomputer for calculation and control of speed and angle. Speed and angle are separately controlled. U.S. Pat. No. 5,359,986 to McGrath, incorporated by reference, discloses a pitching system with a control subsystem in which the user can select a ball speed and the controls set the angle so as to send the ball across a predetermined strike zone. In this system, the ball launch angle is set dependent upon the ball speed setting.

A drawback of these systems is their complexity, both to implement and to use. Kovac' system is designed for practicing tennis. It has a very complicated user interface that makes it difficult to learn and use for the ordinary casual user of batting cages. The McGrath system attempts to simplify the situation for the casual user by reducing the choices to only ball speed, but in doing so makes the system more complicated to implement, by tying control of ball angle (or tilt) to ball speed. McGrath's system is also harder for users to control. A short or tall batter has a different from average strike zone, but the McGrath system predetermines the ball angle as a function of ball speed. McGrath tries to overcome this deficiency by building a second, tilt-override controller, with UP and DOWN control buttons. This unduly adds to the complexity of the apparatus, and adds another layer of potential confusion for the customer.

Accordingly, a better way is needed to enable users to control both ball speed and angle, or height at a batting position, without being locked into a fixed height strike zone.

SUMMARY OF THE INVENTION

The invention is a pitching system comprising a pitching mechanism which is separately controllable as to ball speed and ball angle or tilt, a speed controller which controls speed, an UP/DOWN controller for controlling tilt angle relative to a present position, and a user control panel. The control panel includes user-actuated selectors, preferably buttons, for selecting one of multiple ball speeds and selecting independently of selected ball speed whether to change ball angle UP or DOWN to position the strike zone of the ball. The control panel further includes means for displaying to the user an estimate of the height at which the ball will cross the plate at the selected speed and angle. The displaying means preferably includes a vertical row of lamps, one of which at a time is lit to indicate ball height relative to the plate.

The control panel can further include symbology to indicate a strike zone for one or more heights of batters. In the preferred embodiment, this symbology can include pictures of two different-sized batters positioned alongside the vertical row of lights.

Associated with the displaying means is a ball height-determination logic circuit which takes the selected speed and the present tilt angle and turns on an indicator that corresponds to an estimate of a height at which the ball, launched at the selected speed and tilt angle, will cross the plate.

The height determination circuit can be implemented by a micro-controller that is programmed to turn on the proper lamp based on where the selected speed and UP/DOWN position will produce a ball trajectory across the plate. Preferably, the height determination circuit is implemented in a simple, empirical manner. An input signal indicating the selected ball speed is combined logically with an input signal indicating tilt angle (e.g., the speed and UP/DOWN signal codes sent to the elevation and speed controllers), to produce a signal that selects the appropriate indicator element to turn on. In the preferred embodiment, this is accomplished by inputting offsets for changes in selected ball speed and then incremental steps for changes for elevation. Alternatively but less preferred, output signals from the position and speed controllers, which preferably include feedback encoders, can be sent to the display micro-controller for computing a strike zone height indication. Alternatively, a simple lookup table having inputs from the speed and UP/DOWN buttons could be used for selecting (or addressing) the height indicator element to be turned on as a logical function of the selected speed and tilt angle.

The preferred technique can be implemented using discrete logic but using a micro-controller is preferred because the micro-controller can also be programmed to control other functions not germane to the invention. In the preferred embodiment, codes can be sent on a common serial line from the user control panel to the micro-controller that controls the pitching mechanism to instruct it to move UP or DOWN, causing the mechanism to tilt up or down by a predetermined increment. The same codes can be input to the micro-controller running the height indicator display to turn on an indicator lamp spaced incrementally above or below the presently lit lamp. Ball speed codes can similarly be used to signal the pitching mechanism to shift to a different speed. These signals are simultaneously input to the micro-controller running the height indicator display to turn on a lamp in a higher or lower indicator range, e.g., three lamps above the currently lit lamp if speed is increased by one step.

The invention also includes a simplified method of user operation of a batting cage. The batter selects one of multiple speeds for the ball to cross a batting position, i.e., the plate, preferably as part of a startup sequence for the batting cage. The control panel displays an indication of the estimated height at which the ball will cross the plate for a given tilt angle at which the pitching apparatus is positioned (typically the last position it was in when used before, but alternatively a default, e.g., middle, position). The batter then presses the UP or DOWN button to reposition the tilt angle of the pitching apparatus independently of speed until the indication of ball height is at a desired level for that batter. Or, the batter can change the selected speed again, e.g., from fast to slow speed. The indicator lamps give a prompt feedback to the user of selected changes, even if the tilt and speed control coupled to the pitching mechanism requires a few seconds to reset. A procedure can also be provided to accelerate bringing the elevation indication quickly back into the indicator range when the user changes from one ball speed to another.

Once the batter is satisfied with the speed and height settings, the batter can then actuate a control that starts the machine pitching balls. The batter need not waste balls, or an entire sequence of balls, to select a preferred choice of ball speed and height. The batter can also change ball height by pressing the UP or DOWN button during a pitching sequence, to alter the strike zone through which balls are pitched.

The foregoing and other objects, features and advantages of the invention will become more readily apparent from the following detailed description, which proceeds with reference to the accompanying drawings.

DETAILED DESCRIPTION OF THE PREFERRED EMBODIMENT

Figure 1:
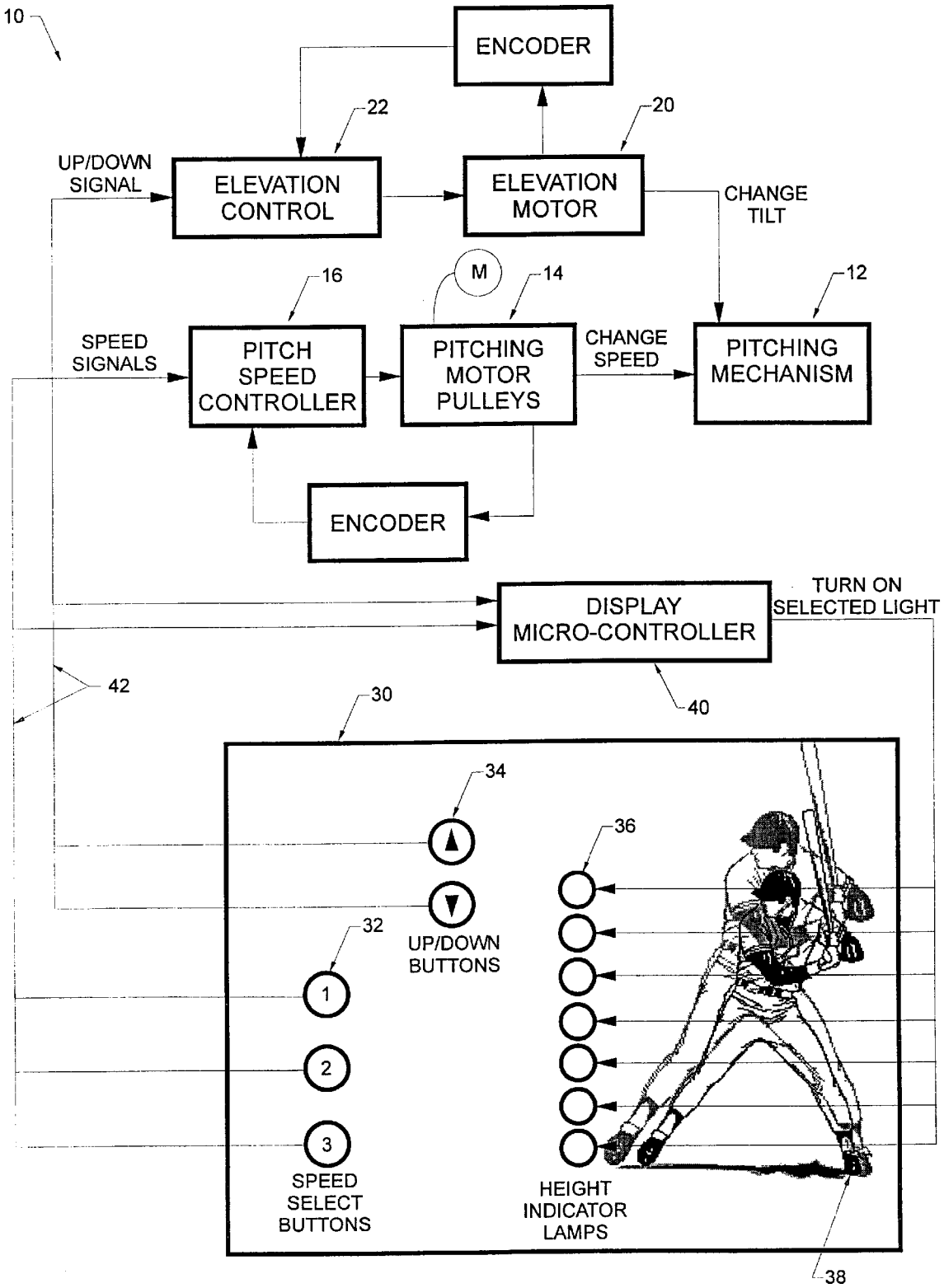
FIG. 1 Functional block diagram of batting cage system

FIG. 1 is a functional block diagram of a batting cage system 10 according to the invention. The system includes a pitching mechanism 12. Such mechanisms are generally known in the art, and most known pitching mechanisms having electrically-controllable ball speed and tilt angle adjustment capabilities can be adapted to the present invention.

Referring back to FIG. 1, a constant speed electric motor M drives the pitching mechanism through infinitely-variable drive pulleys 14 which can be repositioned under control of a pitch speed controller 16. Alternatively, a variable speed motor could be used. Controller 16 includes a micro-controller that is responsive to speed control codes received from speed selector buttons 32 on a user control panel 30.

An elevation motor 20 is coupled to the pitching mechanism 12 to change the tilt angle at which balls are launched. An elevation controller 22 controls motor 20, and includes a micro-controller that is responsive to elevation or tilt control codes received from UP and DOWN selector buttons 34 on user control panel 30.

Figure 3:
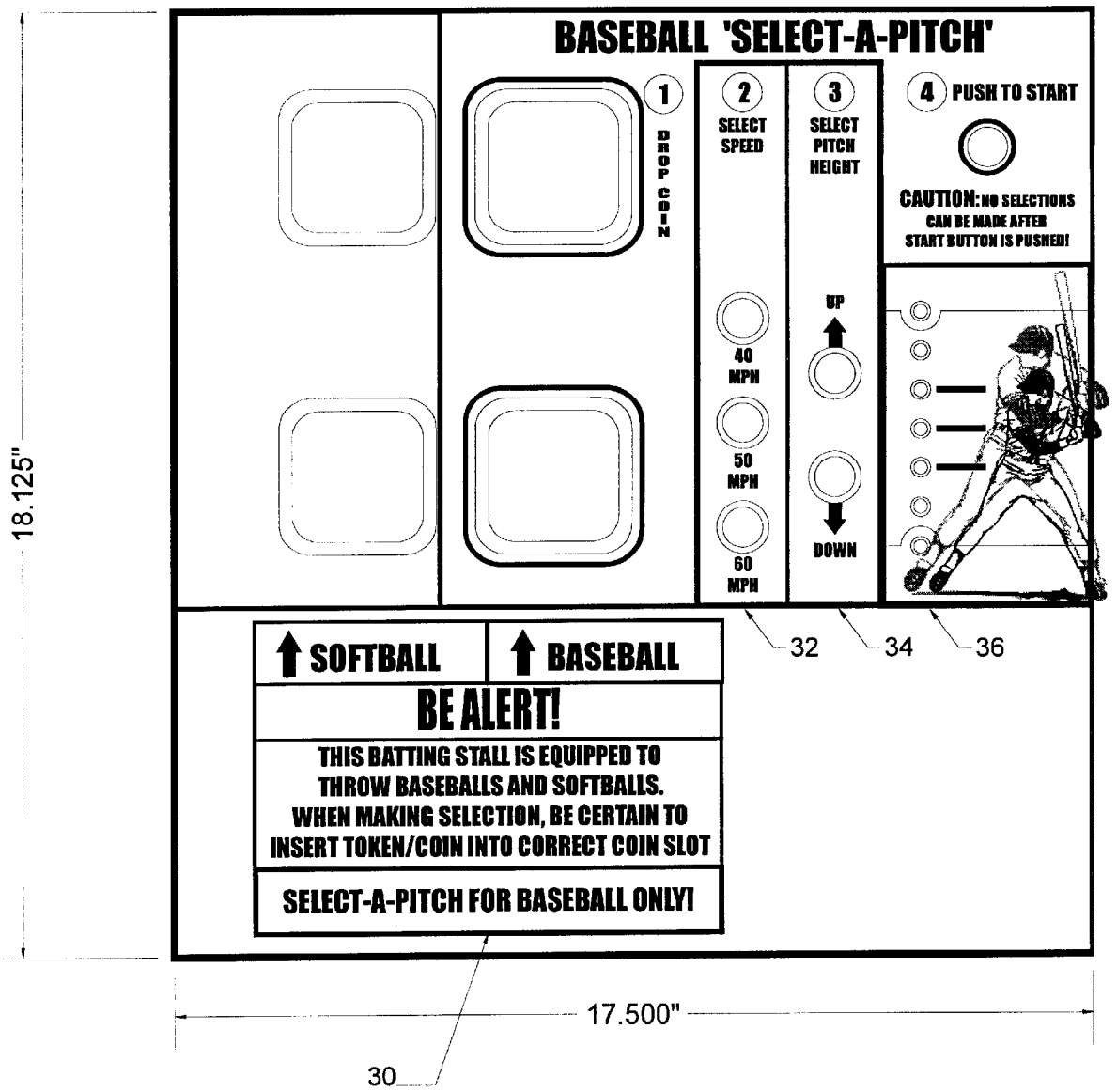
FIG. 3 User control panel (scale drawing)

The control panel 30 also includes a vertical row 36 of lamps or other suitable indicators, preferably super-bright red LEDs, one of which at a time is turned on to signal to the batter at which height to expect a pitch. The preferred arrangement of the control panel 30 is shown in FIG. 3. Preferably an image 38 of a batter is positioned alongside the row 36 of lamps. More preferably, images of batters of two different sizes are shown to give batters of different heights an estimate of the elevation at which the ball is expected to be pitched across the plate relative to their personal strike zone.

The indicator lamps 36 are controlled by a display micro-controller 40, which has as inputs the speed selection signals from buttons 32 and the UP/DOWN selection signals from buttons 34. The preferred micro-controller is a Microchip PIC 16F84 microprocessor having a serial input (BCD-encoded differential serial line) for receiving the speed and UP/DOWN inputs via signal line 42. An internal EEPROM register stores programmed offsets for the indicator lamps, and output connections to a driver chip with parallel open-collector Darlington transistor drivers produce selectable parallel outputs to the LEDs in the row of lamps 36.

Figure 2:
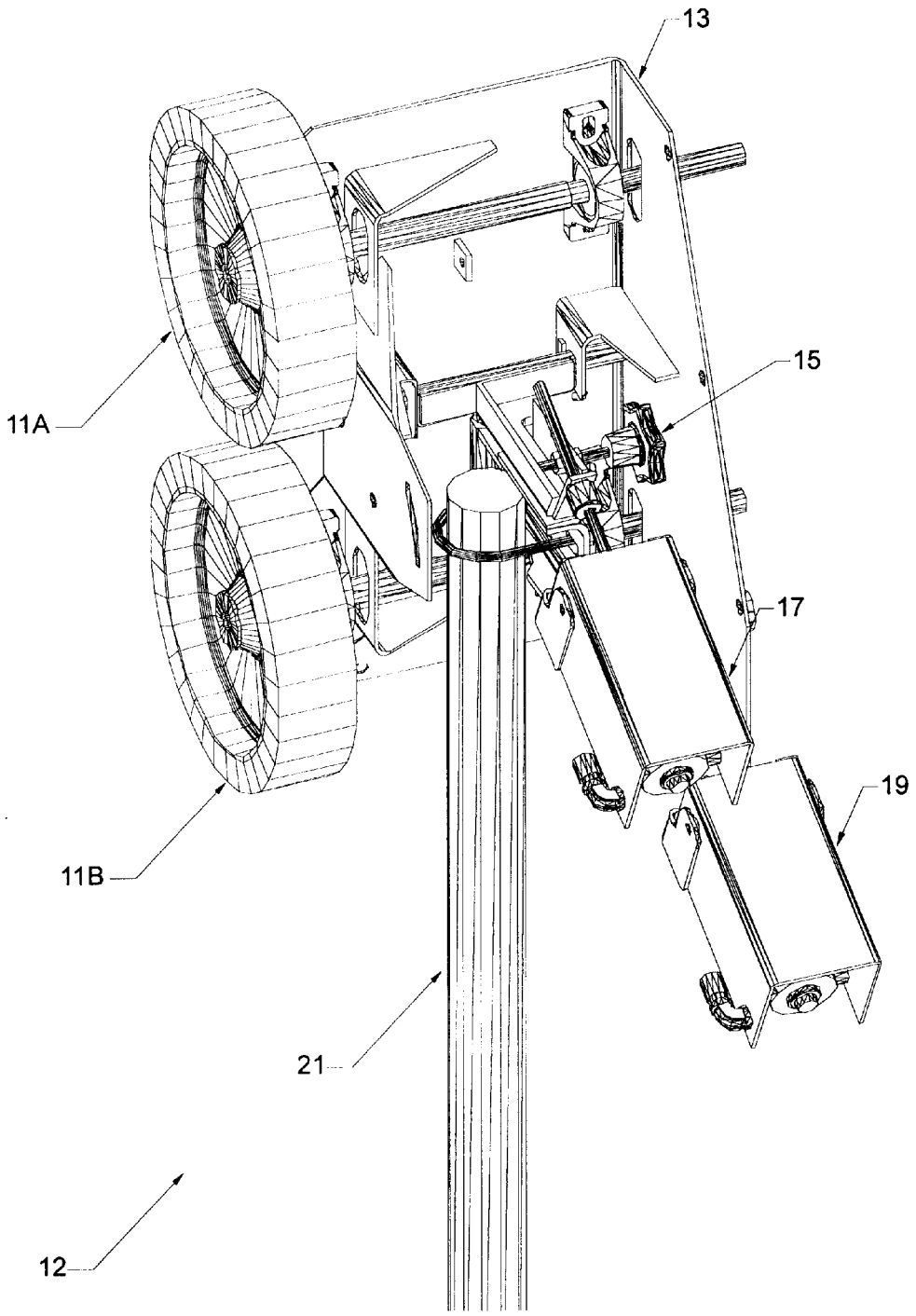
FIG. 2 Schematic of pitching mechanism

FIG. 2 shows the preferred form of pitching mechanism 12. Pitching mechanism 12 includes a pitching machine frame 13 to which are mounted two pitching wheels 11 A and 11B which pitch the ball to the user. Pitching mechanism also includes a left/right adjustment knob 15, a pitch height actuator motor 17 and guard and a pitch speed actuator motor 19 with guard. Finally, the whole device is mounted on a mounting post 21 that supports the pitching mechanism 12 above the ground.

FIG. 3 shows the face of the user control panel 30 of the invention with conventional coin feed receptacles. FIG. 3 is drawn to scale. The user control panel 30 includes speed selector buttons 32, UP and DOWN selector buttons 34, and the row 36 of lamps that indicate the expected height of the pitch.

Figure 4:
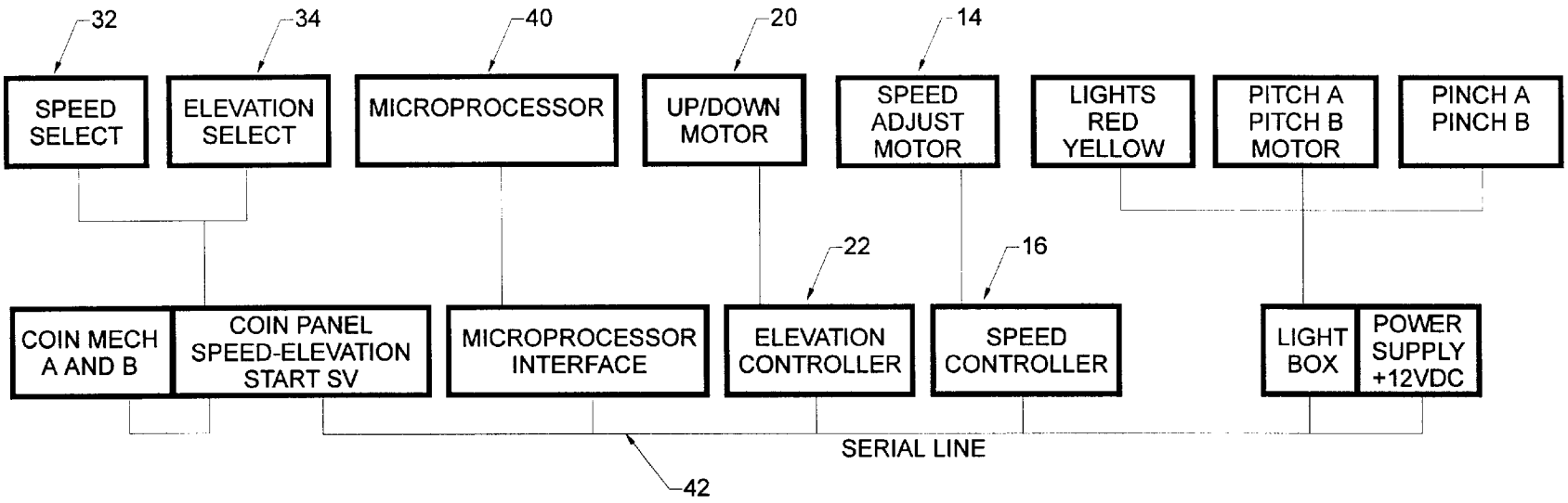
FIG. 4 Functional interconnection of batting cage system

FIG. 4 is a diagram of the system shown functionally in FIG. 1, showing the connection of the serial data line 42 connected to the various control elements of the system 10.

Figure 5:
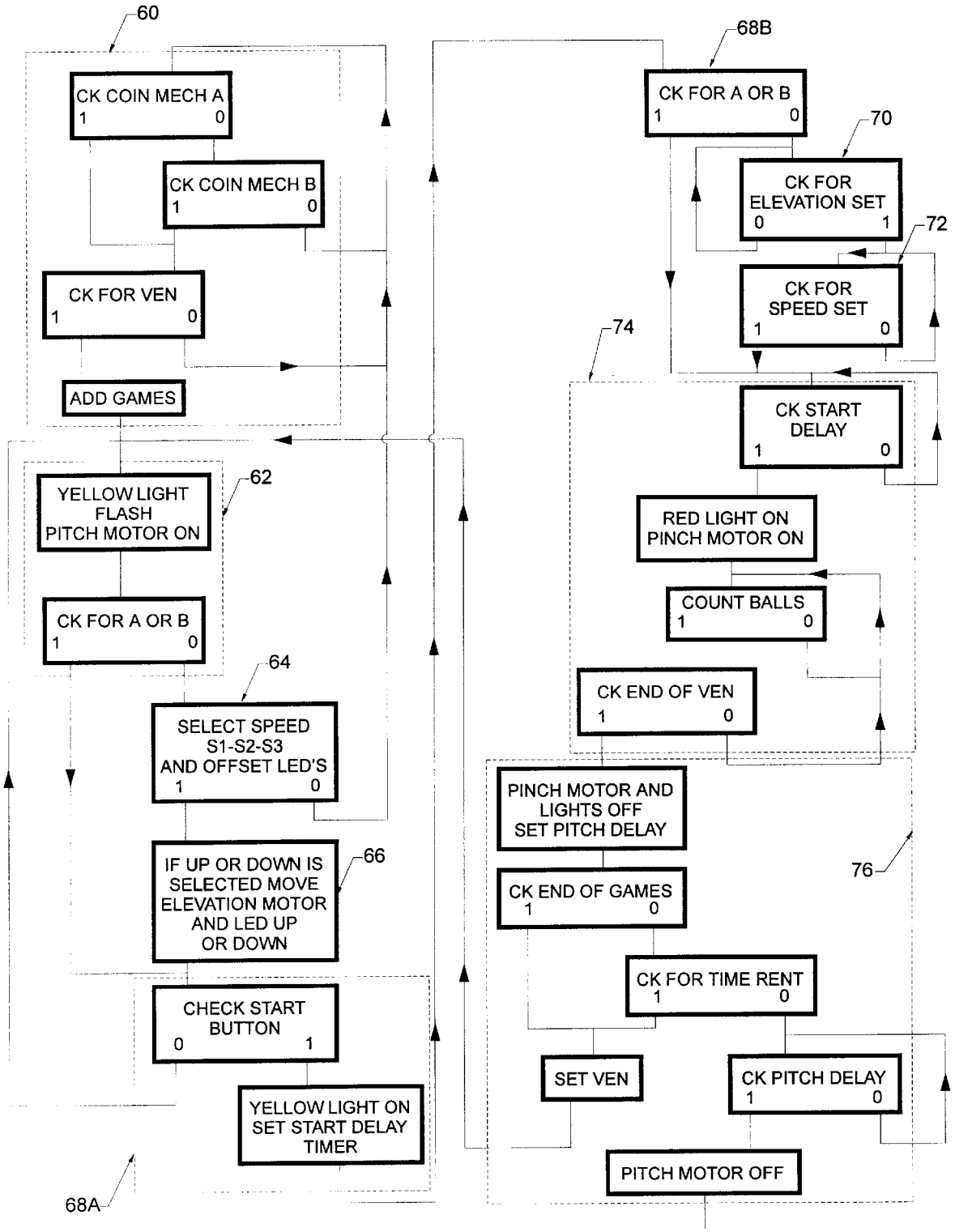
FIG. 5 Batter use flowchart

FIG. 5 is a flow chart of operation of the system 10. At step 60, the system is waiting for a batter to begin a game. At step 62, the system checks to see how many players there are. At step 64, the system accepts a batter's speed choice and sets the offsets 54, 56, 58 (FIG. 6) for the row 36 of lamps. The calculation of offsets is discussed further with regard to FIG. 6, below. At step 66, as the batter adjusts the desired pitch elevation, the system changes the lit light indicating estimated pitch height. At steps 68A and 68B, the system waits for the batter to press the start button, indicating that pitching should begin. At step 70, the system watches to see if the batter has changed the pitch elevation by again pushing on one of the UP/DOWN buttons. At step 72, the system watches to see if the batter has changed the pitch speed by pushing a different speed button. At step 74, the system pitches the requisite number of balls. At step 76, the system shuts down and resets for a new batter.

The speed settings can be varied infinitely in the pitching mechanism 12, but are preferably calibrated to produce a total of four speeds. From among these speeds, some machines are set to a high range of speeds (e.g., 50, 60 and 70 mph) or to a low range of speeds (e.g., 40, 50 and 60 mph). The ball trajectory is flatter at higher speeds than at low speeds. Therefore, the ranges of elevations shown by the indicator lamps need to be adjusted up or down for either the high or low ranges of speeds, and then further adjustable for a given set of three speeds within the high or low range. A sliding scale scheme as shown in FIG. 6 uses offsets to position the light indicators in different ranges for different speeds and then to permit incremental changes in the elevation and the corresponding lit lamp regardless of selected speed, over a wide range of elevations.

Figure 6:
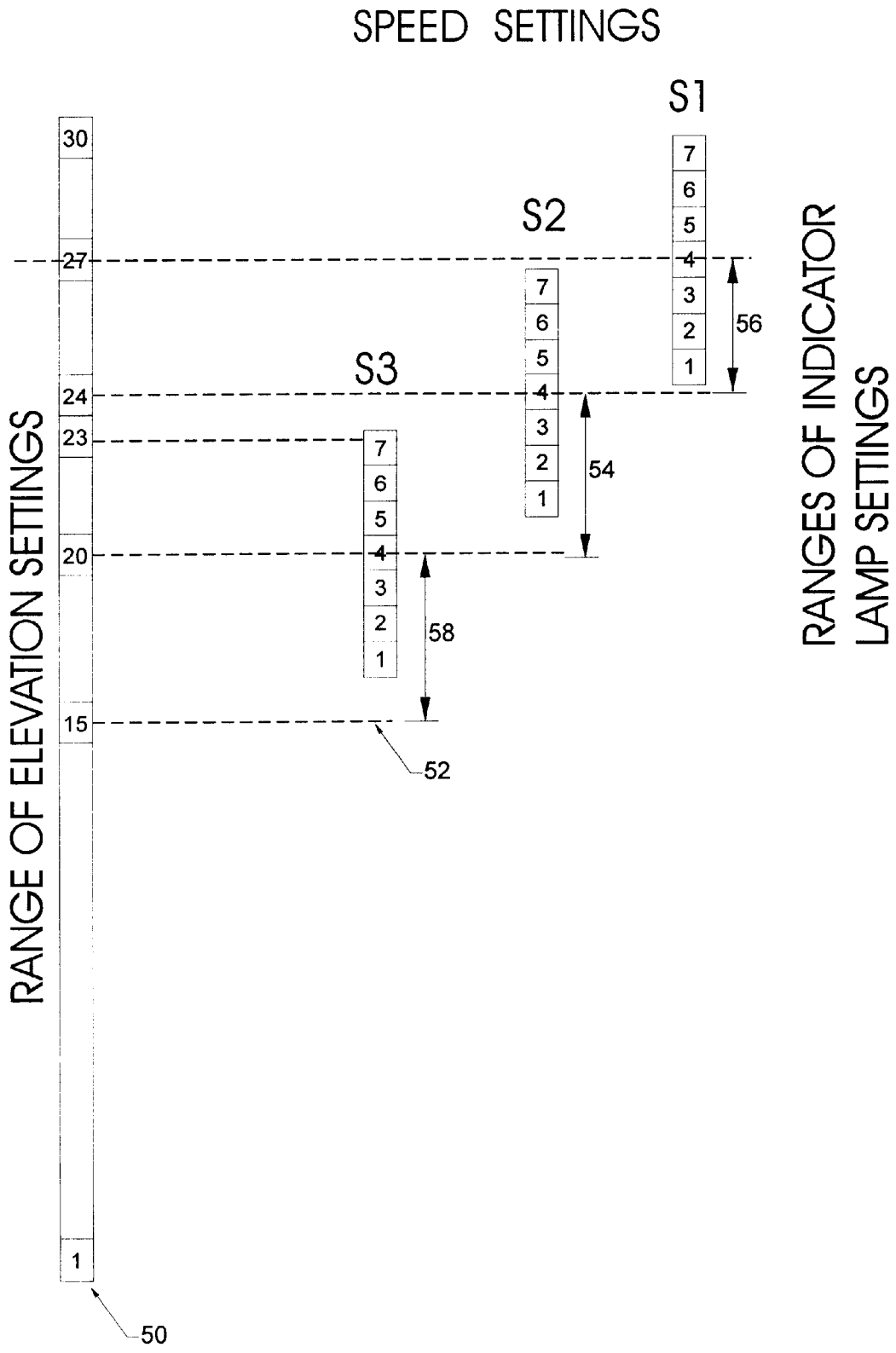
FIG. 6 Indicator lamp settings

FIG. 6 is a diagram showing a range 50 of 30 possible elevations through which the pitching mechanism can be tilted. These elevations are stored in RAM in the micro-controller 40 and are re-initialized each time the machine is restarted. Seven light indicator positions are likewise stored as a sliding scale 52 relative to the range of 30 possible elevations. The position of the sliding scale 52 relative to the elevation range 50 is determined by pre-stored offsets 54, 56, and 58 bound to the codes received from the speed selection buttons. The offsets between speeds is a difference of some number of increments between the center points (4) of each scale determined relative to a starting offset 58 relative the center of the elevation scale 50. Specifically, offset 58 determines the center height (4) for speed S3 relative to the middle elevation (15) of the range 50 of elevation settings. Offset 54 determines the center height (4) for speed S2 relative to the center height (4) of speed S3. And offset 56 determines the center height (4) for speed S1 relative to the center height (4) of speed S1. The offsets 54, 56, and 58 are adjustable so that, regardless of the speed of the pitching mechanism 12, the balls pitched can be hit by the user.

The selection of the lamp to be lit is changed incrementally within the range of seven indicator positions by pushing the UP/DOWN buttons. For a given offset, it is possible for the user to push the elevation up or down, beyond the sliding scale 52 of the light indicators, but the capability to display elevation on the indicator lamps is still limited to the upper and lower ends of the range of elevations 50. When out of range, the uppermost or lowermost light will be lit until the opposite-direction UP/DOWN button has been pushed enough times to bring the elevation indicator within the sliding scale 52 of the lamps. This elevation will vary depending on the position of the sliding scale 52 position of the lamp settings as determined by the offset applicable to the speed selected, as discussed in the next section.

Elevation Indicator and Speed Function

At startup of the system, the elevation adjust motor is initialized to a mid-adjustment position (e.g., location 15 in FIG. 6); the elevation position lights (LEDs) are set to center LED 4. This position can be changed by offset 58 upon selecting the high speed range (50, 60, 70 mph).

After coin drop, the speed select button LEDs flash until a speed (S1, S2 or S3) is selected. The LED for the selected speed is then on steady. At the same time, a code 1, code 2, or code 3 is sent to the speed control block 16 and to the elevation LED indicator block (micro-controller 40). The code that is sent to the speed control block 16 selects a speed reference number for the pitch wheels of mechanism 12. The code sent also tells the LED micro-controller 40 to add an offset number to the center LED position.

The speed reference number and the position offset numbers are programmed into the system at installation. The offset number determines how much the storage elements controlling the indicator lamps are shifted relative to the center slot 15 of the available 30 elevation slots as shown in FIG. 6. For example, a change from speed S3 to S2 can be programmed to give an offset 54 of 4, raising the centerpoint (element 4) of the range through which the indicator lamps can be changed to coincide with elevation position 24 on scale 50. Changing to speed S1 can add an offset 56 of an additional 3, changing the center position of the LEDs to elevation position 27 on scale 50.

After speed selection, the elevation adjustment and the start LEDs flash.

The elevation may now be changed by moving the elevation motor up or down. The up button sends a code 4 and the down button sends a code 5. Each code 4 will cause the elevation motor to turn ½ revolution clockwise moving the tilt of the machine top back. A code 5 will cause the motor to turn ½ revolution counterclockwise, moving the machine top forward.

Code 4 will also increment the LEDs up and code 5 will increment the LEDs down. The LED UP/DOWN increment is added to the speed offset to indicate the expected pitch elevation. The user may change the elevation of the pitching mechanism 12, as shown by the indicator lamps 36, during the game.

All of the functions may be programmed independently. The elevation control motor and the speed control motor can each be moved and the position of each motor saved. The LED offset for each speed is also programmable. At the time of installation, these parameters are all set to indicate the initial elevation of the pitched ball calibrated mechanically and electrically to the pitching mechanism.

The system is reset on power down and comes up with the proper presets.

Each control function is a separate microprocessor and only the control panel sends commands to the control blocks. No communication need exist between the control blocks that control the tilt or speed and the LED elevation indicators.

On initialization, the elevation position is set first. When the position is set, the position controller sends a code 15. This enables the speed control motor to then set the speed. After the speed is set, the speed controller sends a code 16 to enable the light box. At this point, the game is now ready to play. The initialization procedure is described in further detail below, with reference to FIG. 7.

As mentioned above, the user may change ball speeds before or during a game, and this change will often cause the ball to be pitched at an elevation that is "out-of-range"—above or below the range of the indicator lamps. The display micro-controller 40 includes programming for a procedure to accelerate bringing the tilt angle of the pitching mechanism and the elevation indication back into a range of the height indicator lamps 36. This routine is described with two examples, referring to FIG. 6.

In the first example, if the user has been batting with the ball speed set at speed S2 and with the elevation indicator at the center position (lamp 4 in the S2 range, which corresponds to slot 24 in elevation scale 50), and then pushes the faster speed button S3, the indicator range is shifted by the applicable offset to range S3. The highest lamp in range S3, lamp 7, is positioned at slot 23 of the elevation scale 50, one step below the slot 24 that corresponds to the middle lamp 4 in the indicator range for speed S2. The highest lamp in the row of indicator lamps is turned on to show that the elevation of a pitched ball will be above the user's head. When the user then pushes the DOWN button to lower the elevation, a corresponding code is sent to both the micro-controller 40 and the elevation controller 22 via the serial line 42. The micro-controller 40 tests to determine whether this change brings the elevation back into range of the indicators and, since it does in this example, the micro-controller 40 merely continues to light the top lamp.

In the second example, if the user had originally been batting with the lowest speed setting S1, at mid-range height with lamp 4 lit, corresponding to elevation slot 27, and then switched to the fastest ball speed S3, the distance from slot 27 to slot 23 is four steps. Therefore, in this example, a single push of the DOWN button is insufficient to bring the elevation back into range of the indicators. This out-of-range condition is detected by the micro-controller 40, which then proceeds to issue three code 5 symbols in addition to the one issued when the user pushed the DOWN button.

The additional three code symbols are transmitted over the serial line 42 to the elevation controller 22. The controller 22 responds to these additional code symbols by lowering the tilt angle of the pitching mechanism 12 by an additional three steps, at about one step per quarter second.

Micro-controller 40 then waits to see if the user presses the down button again. If the user does so, the micro-controller 40 checks again to see if the indicators are still out of range. If so, the micro-controller 40 again sends three code 5 symbols. This procedure repeats until the elevation is within the indicated range for the selected speed.

Once the elevation is within range (in range S3, when lamp 7 corresponds to slot 23 or lower in scale 50), the micro-controller 40 ends the acceleration routine. The micro-controller 40 then only responds to a push by the user of one of the UP/DOWN buttons to receive a single code 4 or 5. It only increments or decrements the lamp that is turned on by a single step, as long as the requested change of elevation is within the indicator range for the selected speed.

The foregoing examples describe switching from a mid-speed or low speed to the high speed, and how the out-of-range condition applies relative to the upper end of the row of indicator lamps. The same behavior occurs when switching in the opposite direction, from high or mid speeds to the lowest speed, relative to the lowest lamp in the row of indicator lamps.

Figure 7:
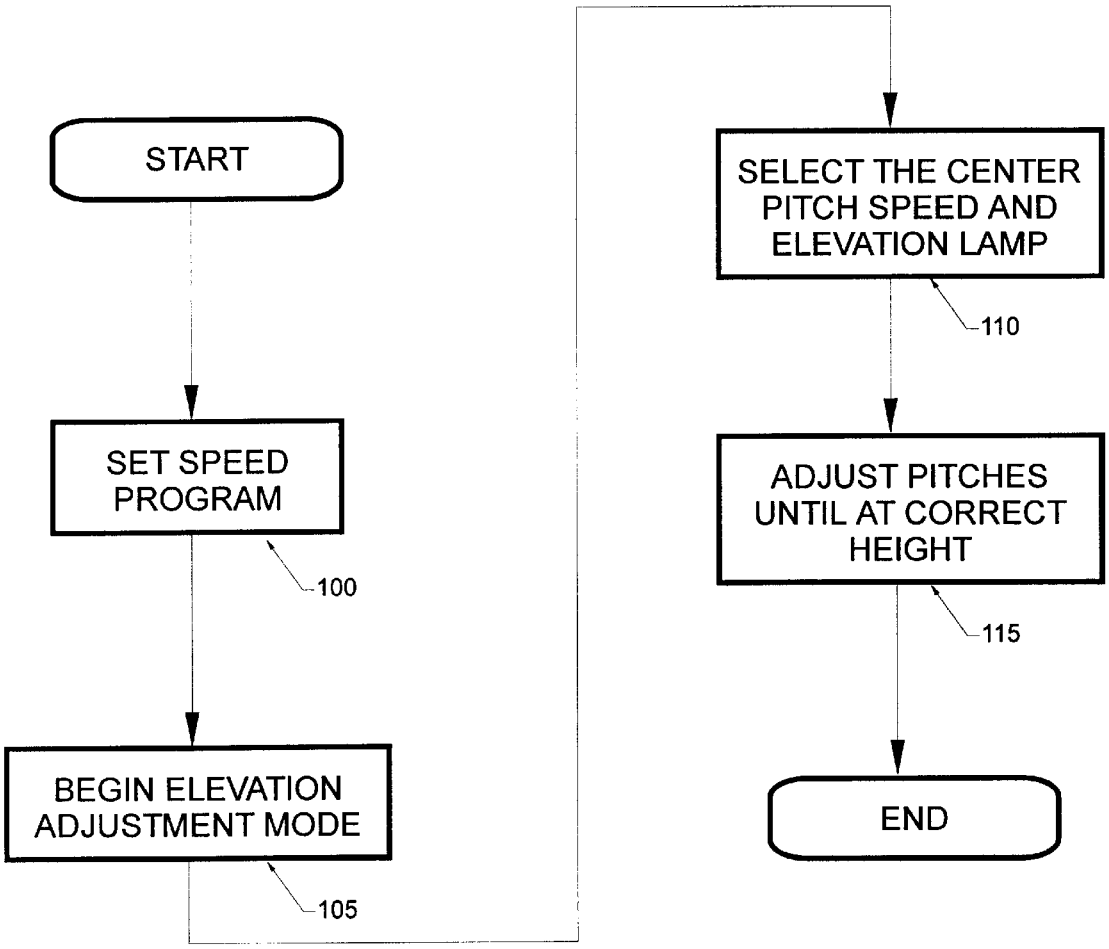
FIG. 7 Initialization flowchart

FIG. 7 is a flowchart showing the procedure for initializing the invention. At step 100, the owner selects the desired speed settings. As discussed above, the system may be programmed with an infinite number of speeds, but is preferably calibrated to produce a total of four speeds. From among these speeds, some machines are set to a high range of speeds (e.g., 50, 60 and 70 mph) or to a low range of speeds (e.g., 40, 50 and 60 mph). Then at step 105 the owner begins to adjust the elevation indicator by starting a game. The owner selects the medium speed pitch and uses the up and down selectors to adjust the elevation until the center elevation lamp of the row 36 of lamps is lit (step 110). Note that the center elevation lamp will vary depending on the height of the average expected batter. The owner then enters a programming sequence and uses the up and down selectors at step 115 to adjust the pitch elevation without changing the lit lamp.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A user control panel, the panel designed to control a batting cage pitching mechanism and to display visually to a user a predicted pitch height, the panel comprising:

an actuator for a user to input a selection of a tilt angle of the pitching mechanism; and an array of lamps arranged on the panel to display an estimated pitch height for a selected tilt angle before the first ball is pitched at the selected tilt angle.

2. A user control panel according to claim 1, further including a plurality of buttons, each button for selecting a different ball speed.

3. A user control panel according to claim 1, wherein the actuator for a user to input a selection of a tilt angle includes UP/DOWN buttons for the user to push to actuate raising or lowering the tilt angle of the pitching mechanism; and the array of lamps is arranged to display a new pitch height responsive to actuation of the UP/DOWN buttons before a next ball is pitched at the input selected tilt angle.

4. A user control panel according to claim 1, wherein the array of lamps includes a vertical row of lamps, one of which is lit to show the estimated pitch height.

5. A user control panel according to claim 4, further including a picture of a batter alongside the vertical row of lamps to indicate ball height relative to the batter.

6. A user control panel according to claim 1, further including graphical indicia defining a representative strike zone alongside the array of lamps.

7. A user control panel according to claim 1, further including a coin slot for accepting money to begin operating the batting cage pitching mechanism.

8. A user control panel according to claim 1, further including a start button for the user to push to start operation of the pitching mechanism when satisfied with the estimated pitch height shown by the array of lamps.

9. A user control panel, the panel designed to control a batting cage pitching mechanism and to display visually to a user a predicted pitch height, the panel comprising:

an actuator for a user to input a selection of a tilt angle of the pitching mechanism;

a vertical row of lamps arranged on the panel, one of which is lit to display an estimated pitch height for a selected tilt angle before the first ball is pitched at the selected tilt angle; and graphical indicia defining a representative strike zone alongside the vertical row of lamps.

10. A user control panel according to claim 9, wherein the actuator for a user to input a selection of a tilt angle includes UP/DOWN buttons for the user to push to actuate raising or lowering the tilt angle of the pitching mechanism.

11. A user control panel according to claim 9, further including a plurality of buttons, each button for selecting a different ball speed.

12. A user control panel, the panel designed to control a batting cage pitching mechanism and to display visually to a user a predicted pitch height, the panel comprising:

a plurality of buttons, each button for selecting a different ball speed;

UP/DOWN buttons for the user to push to actuate raising or lowering a tilt angle of the pitching mechanism;

a vertical row of lamps arranged on the panel, one of which is lit to display an estimated pitch height for a selected tilt angle before the first ball is pitched at the selected tilt angle; and graphical indicia defining a representative strike zone alongside the vertical row of lamps.

* * * * *